343-700 MS AU 254 EX
4/5/83 OR 4,379,296

United States Patent [19]
Farrar et al.

[11] 4,379,296
[45] Apr. 5, 1983

[54] SELECTABLE-MODE MICROSTRIP ANTENNA AND SELECTABLE-MODE MICROSTRIP ANTENNA ARRAYS

[75] Inventors: Frederick G. Farrar; Daniel H. Schaubert, both of Silver Spring, Md.

[73] Assignee: The United States of America as represented by the Secretary of the Army, Washington, D.C.

[21] Appl. No.: 198,673

[22] Filed: Oct. 20, 1980

[51] Int. Cl.[3] ..... H01Q 1/38
[52] U.S. Cl. ..... 343/700 MS; 343/829
[58] Field of Search ..... 343/700 MS, 829, 830, 343/854

[56] References Cited

U.S. PATENT DOCUMENTS 3,680,136 7/1972 Collings ..... 343/700 MS
4,053,895 10/1977 Malacisi ..... 343/700 MS
4,259,670 3/1981 Schiavone ..... 343/700 MS

*Primary Examiner*—Eli Lieberman
*Attorney, Agent, or Firm*—Nathan Edelberg; Robert P. Gibson; Saul Elbaum

[57] ABSTRACT

An inexpensive, flush mounted selectable mode microstrip antenna which is frequency-agile and has polarization diversity. The mode, frequency and polarization of the antenna can be selected by selecting the location of shorting posts in the antenna. The use of switching diodes in place of shorting posts provides the means of electronically switching the mode, frequency and polarization characteristics of the antenna. The selectable mode microstrip antenna arrays are also provided. The selection of mode, frequency and polarization can be selected and controlled by digital means such as a computer.

13 Claims, 22 Drawing Figures

SELECTABLE-MODE MICROSTRIP ANTENNA AND SELECTABLE-MODE MICROSTRIP ANTENNA ARRAYS

RIGHTS OF THE GOVERNMENT

The invention described herein may be manufactured, used or licensed by or for the Government of the United States of America for governmental purposes without payment to us of any royalties therefor.

CROSS REFERENCES TO RELATED APPLICATIONS

This invention is related to the following U.S. Pat. applications; ANTENNA WITH POLARIZATION DIVERSITY, Ser. No. 103,798, filed Dec. 14, 1979 by Daniel H. Schaubert et al., and FREQUENCY-AGILE, POLARIZATION DIVERSE MICROSTRIP ANTENNAS AND FREQUENCY SCANNED ARRAYS, Ser. No. 175,543, filed Aug. 5, 1980 by Daniel H. Schaubert, et al.

BACKGROUND OF THE INVENTION

This invention relates generally to microstrip antennas and microstrip antenna arrays and is particularly directed to microstrip antennas and arrays which have selectable radiation patterns at a single frequency. This invention also provides polarization diversity in these selectable mode microstrip antennas and arrays. This invention is also particularly directed to selectable mode antennas and arrays that are frequency-agile. The selectable mode, frequency-agility and polarization diversity is achieved in a single microstrip patch.

The microstrip antenna has been shown to be an excellent radiator for many applications requiring thin, inexpensive, conformal antennas which are rugged and have a low aerodynamic profile. However, many uses require a selectable radiation pattern. To achieve selectable mode capabilities in prior art antennas it was necessary to provide more than one microstrip patch, which was space and weight inefficient. For example, if it was desired to operate as a homing device and selectable mode capability was desired, it was necessary to provide alternate radiating patches of different dimensions.

For many applications, such as direction finding, fuzing, beam splitting, side lobe cancelling and low-gain beam steering, it is often highly desirable, especially when dealing with projectiles, missiles, aircraft and radar, to have single conductive patch microstrip antennas that have the capability of exhibiting selectable radiation patterns at a single frequency. It is also often highly desirable to have the capability of switching modes instantaneously, such as being computer controlled. The prior art single conductive patch microstrip antennas do not have the capability of selectable radiation patterns which can be switched rapidly and simply.

It is also highly desirable to have a selectable mode microstrip antenna or array that has selectable polarization diversity. Tc obtain polarization diversity in most prior art antennas it is necessary to have at least two antenna feeds and associated power dividers, phase shifters and rf switches to provide complete polarization coverage. For many applications it would be beneficial to obtain polarization diversity with simple inexpensive equipment that is easily controlled or that can be controlled by a digital computer.

Another highly desirable feature for many applications is to have a selectable mode microstrip antenna that is frequency-agile, as well as being polarization diverse. The prior art does not show single selectable mode microstrip antennas that have frequency-agility.

This invention provides a method to achieve selectable radiation patterns, frequency-agility and polarization diversity in both individual antenna elements and arrays and a method to achieve rapid selection of a radiation pattern, polarization, and frequency. The described method is inexpensive, easily constructed and easily controlled.

It is therefore one object of this invention to provide a microstrip antenna which is capable of selectively exhibiting selectable radiation patterns.

It is another object of this invention to provide a selectable mode microstrip antenna that is capable of providing selectable polarization.

It is a further object of this invention to provide a selectable mode microstrip antenna that is capable of providing frequency-agility.

It is still another object of this invention to provide a microstrip antenna that provides selectable radiation patterns, selectable polarization and selectable frequencies by means of simple electronic switching capable of being computer controlled, and thus instantaneously changeable.

It is still a further object of this invention to provide a microstrip antenna array that exhibits selectable radiation patterns, selectable polarization and selectable frequencies which are constructed by standard printed circuit techniques and are conformable and have low profile and desirable aerodynamic qualities.

SUMMARY OF THE INVENTION

These and other objects, features and advantages of the invention are accomplished by a microstrip antenna which essentially comprises a dielectric substrate, a conductive layer forming a ground plane on one surface of the substrate, one or more conductive patches on an opposed surface, as rf transmission path to the conductive patches and means to select the radiation pattern mode of the antenna. Means can also be provided to select the polarization and frequency of the antenna. The means proposed to select the mode, frequency and polarization of the antenna are shorting means to provide an electrical short circuit between selected locations on the one or more conductive patches to the ground plane. These shorting means may be shorting posts, switching diodes or other means to provide an electrical short circuit between the one or more conductive patches and the ground plane. The shorting posts may be permanently or removeably installed. The switching diodes may be externally controlled by means such as computer controlled bias circuits. With more than one conductive patch comprising the antenna, each individual conductive patch can be made to exhibit selected radiation pattern modes.

BRIEF DESCRIPTION OF THE DRAWINGS

The above and further objects and novel features of the invention will more fully appear from the following description when the same is read in connection with the accompanying drawings. It is to be understood, however, that the drawings are for the purpose of illustration only, and are not intended as a definition of the limits of the invention.

DESCRIPTION OF THE PREFERRED EMBODIMENT

Figure 1A:
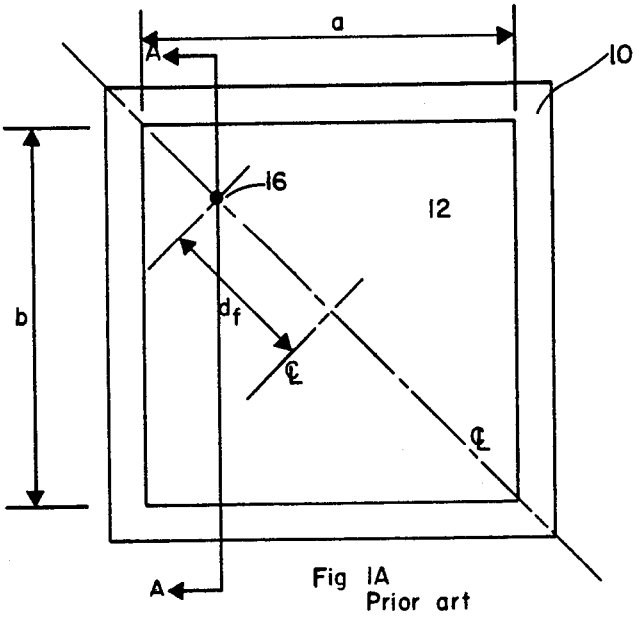
Fig 1A Prior art
FIGS. 1A and 1B illustrate a microstrip antenna as known in the prior art.
Figure 1B:
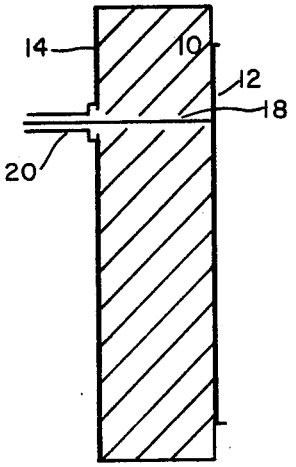

Referring now to the drawings, wherein like reference characters designate like or corresponding parts throughout the several views, FIGS. 1A and 1B illustrate a microstrip antenna as known in the prior art. Basically the microstrip antenna consists of a dielectric substrate 10, with substantially parallel surfaces, a conductive patch 12 formed on one surface of the substrate and a ground plane 14 formed on the opposed surface of the substrate. The FIGS. show the conductive patches 12 as square, however, it is noted that rectangular patches also can be used, except in situations wherein circular polarization is desired. An rf transmission path is provided and may be one of several types such as a coaxial conductor, microstrip, stripline, wave guide, etc. FIG. 1B illustrates the method of connecting a coaxial conductor 16, with the outer lead 20 connected to the ground plane 14 and the inner lead 18 connected to the conductive patch 12. The dielectric substrate 10 is made of a low loss dielectric substrate such as Teflon-fiberglass. The conductive patch 12 and the ground plane 14 are formed on the dielectric substrate by means known in the art, such as being etched on the substrate by standard printed circuit techniques. The operating characteristics of the microstrip antenna as shown in FIGS. 1A and 1B are a function of the conductive path dimensions, a and b, the transmission path location $d_f$, and the permittivity of the substrate 10.

Figure 2A:
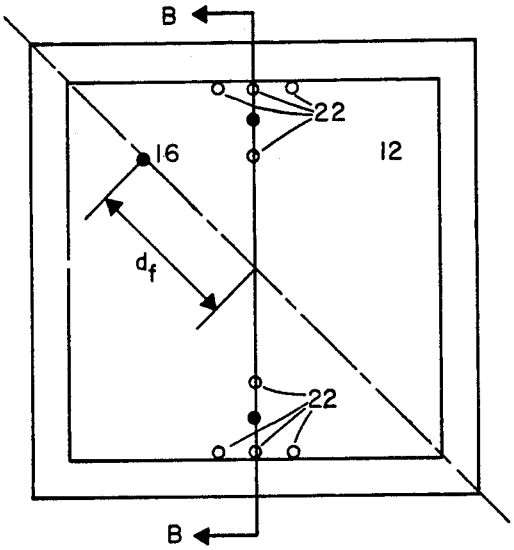
FIGS. 2A and 2B illustrate a microstrip antenna of the present invention showing shorting posts.
Figure 2B:
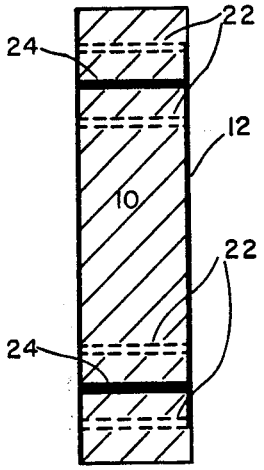

FIGS. 2A and 2B illustrate an embodiment of the present invention wherein the same basic microstrip antenna as shown in FIGS. 1A and 1B is modified to enable the operating characteristics of the conductive patch to be changed. The microstrip antenna is provided with shorting means to provide a conductive path between ground plane 14 and conductive patch 12. The shorting means shown in FIGS. 2A and 2B are shorting posts 24 which are placed in preselected prepositioned holes 22 to provide the desired mode characteristics. The transmission path 16 is placed at an appropriate location such as a distance $d_f$ along the diagonal from the center of the conductive patch 12. The distance $d_f$ is chosen to provide the desired input impedance. The shorting posts 24 may be of any conductive material such as a metallic bolt or rivet.

Figure 3A:
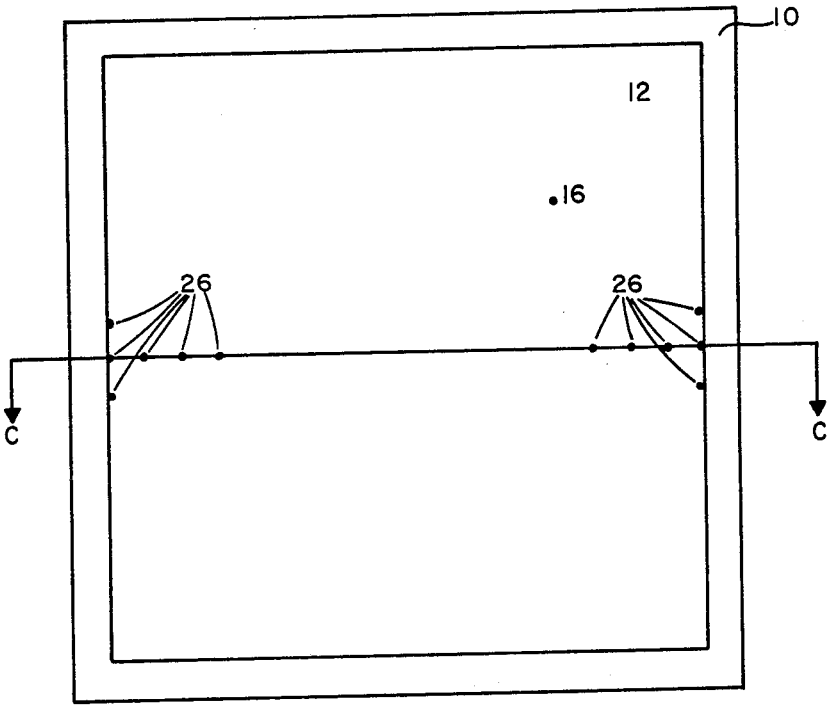
FIGS. 3A and 3B illustrate a microstrip antenna of the present invention with shorting diodes and an external bias circuit control.
Figure 3B:
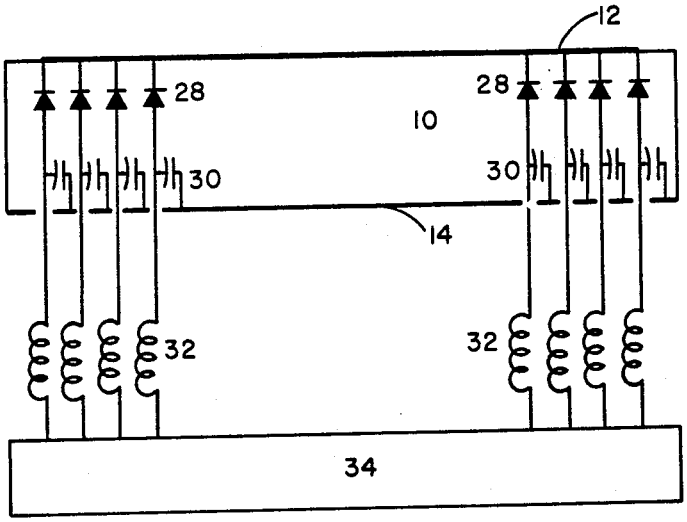
Figure 4A:
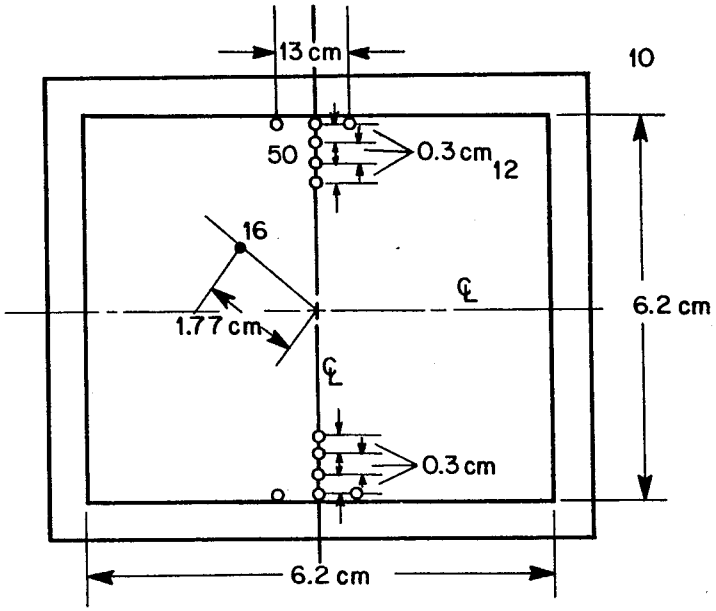
FIGS. 4A–4D illustrate a microstrip antenna of the present invention showing actual shorting means locations and radiation patterns resulting therefrom.
Figure 4B:
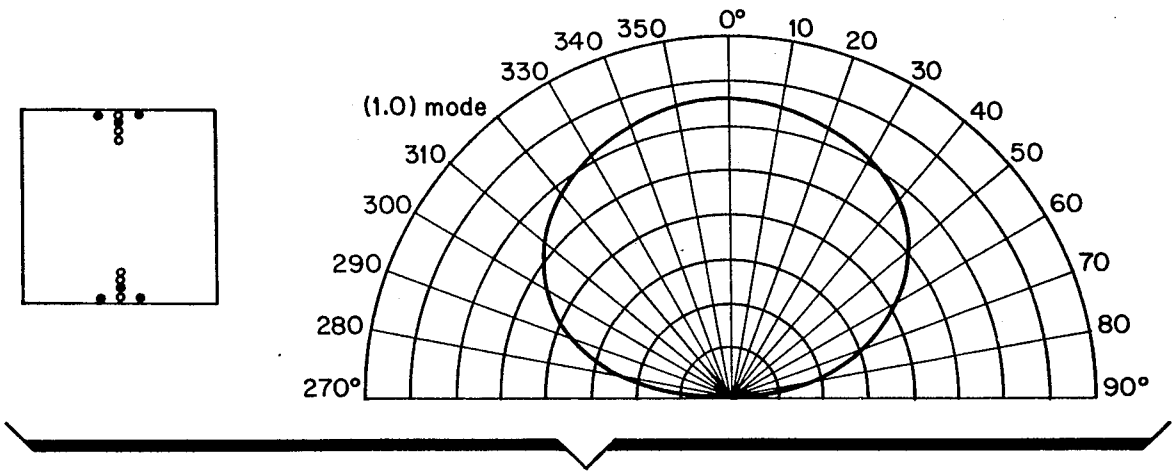
Figure 4C:
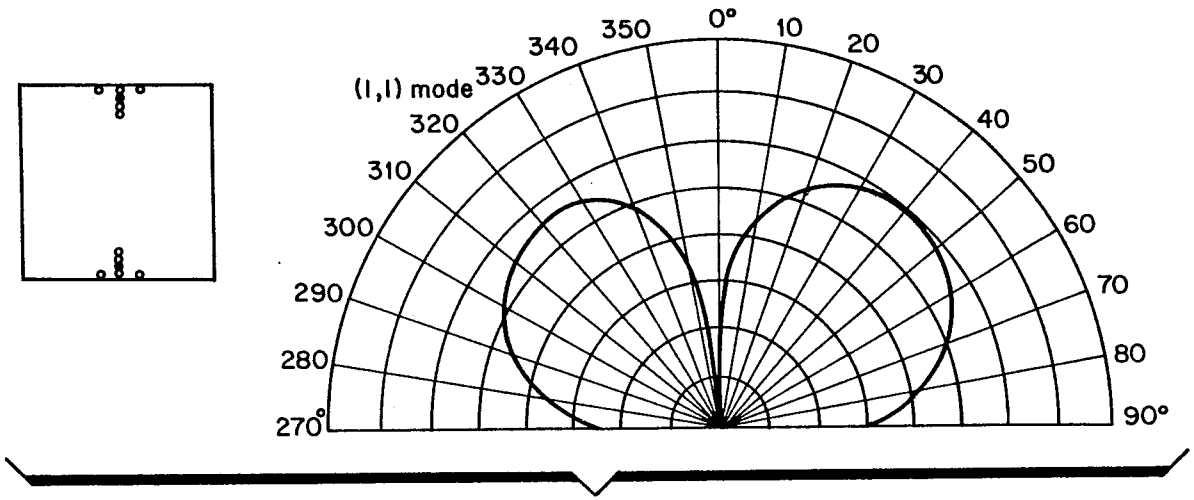
Figure 4D:
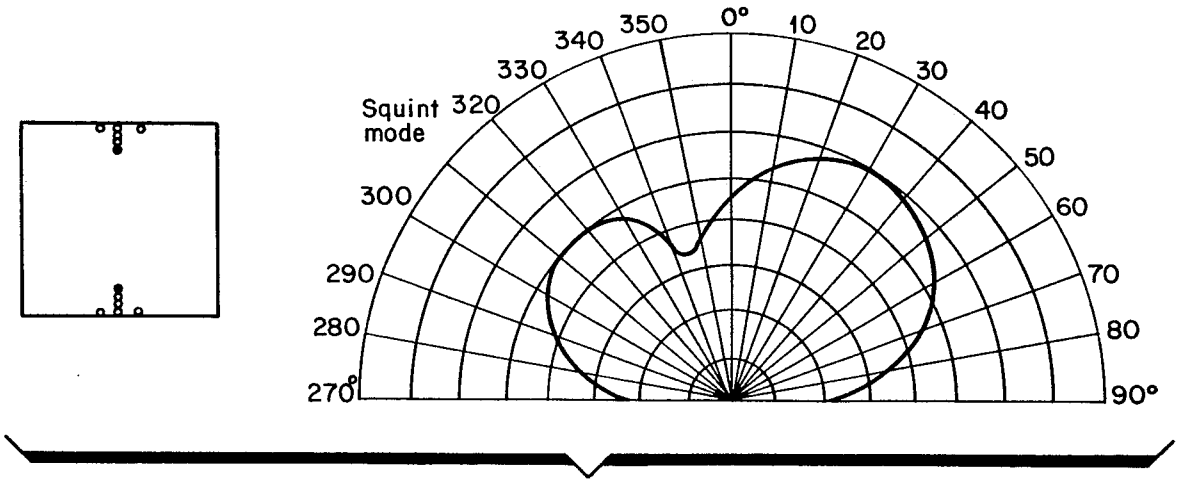

FIGS. 3A and 3B show a further embodiment of the present invention wherein the shorting means are switching diodes 28 placed at preselected positions as shown generally at 26. FIG. 3B is a sectional view taken at CC of FIG. 3A and shows the method of connection of the switching diodes 28. The switching diodes are coupled to the ground plane 14 by rf bypass capacitors 30 and coupled to an external bias circuit 34 by rf chokes 32 which preclude rf going back to the external bias circuit 34. The external bias circuit 34 is controllable by a simple means such as a digital computer. FIG. 4A illustrates a specific example of the present invention. This specific example is given as an illustration only and is not to limit the scope of the results obtainable. The dimensions of the microstrip antenna are as shown in FIG. 4A with a substrate thickness equal to 0.16 cm and the dielectric constant equal to 2.55. FIGS. 4B–4D illustrate the radiation pattern modes available. Hereinafter, the filled in circles represent the shorted shorting means. FIG. 4B illustrates the (1, 0) mode and is achieved by shorting the shorting means as shown. FIG. 4C illustrates the (1, 1) mode and is achieved by shorting the shorting means as shown. FIG. 4D illustrates the squint mode and is achieved by shorting the shorting means as shown.

The theoretical basis of the present invention derives from the following considerations. As is well known in the prior art, a microstrip antenna of a given size has various resonant frequencies, and these frequencies can be derived by the following equation:

$$f_r(m, n) \simeq \frac{c\sqrt{m^2 + n^2}}{\sqrt{\epsilon_r}\,(2a)}$$

where m, n = resonant mode constants $\epsilon_r$ = relative dielectric constant a = length of a side c = speed of light.

Therefore, using this formula, the resonant frequencies for a given size antenna can be calculated. For example, with a = 6.2 cm and $\epsilon_r = 2.55$ the resonant frequencies can be calculated as follows:

$$f_r(1, 0) \simeq \frac{30{,}000\sqrt{1^2 + 0^2}}{\sqrt{2.55}\,(2)\,(6.2)} = 1515 \text{ MHz}$$

$$f_r(1, 1) \simeq \frac{30{,}000\sqrt{1^2 + 1^2}}{\sqrt{2.55}\,(2)\,(6.2)} = 2143 \text{ MHz.}$$

From this it can be seen that the prior art antennas were deficient in that if it was desired to exhibit the (1, 0) mode as shown in FIG. 4B and alternately exhibit the (1, 1) mode as shown in FIG. 4C, it was necessary to change the frequency for a given size antenna. However, if it was necessary to transmit or receive at a given frequency it was necessary to have two separate antennas. For example, if it was desired to receive or transmit at the (1, 1) mode at the same frequency as the (1, 0) mode, it was necessary to provide an additional antenna with sides equal to 8.77 cm. It is noted that the squint mode as shown in FIG. 4D cannot be obtained by prior art devices. Referring to FIGS. 4A–4D, the placement of shorting means shown generally at 50 in FIG. 4A allows the radiation patterns of the transmitted or received signal to be changed by shorting selected shorting means as shown in FIGS. 4B–4D. To obtain the squint mode shorting means are placed at locations between those for the (1, 0) mode and the (1, 1) mode. It is noted that the beam maximum in the squint mode radiation pattern, as shown in FIG. 4D can be shifted by changing the locations of the shorting means. These radiation patterns are all obtained at a single frequency.

Figure 5A:
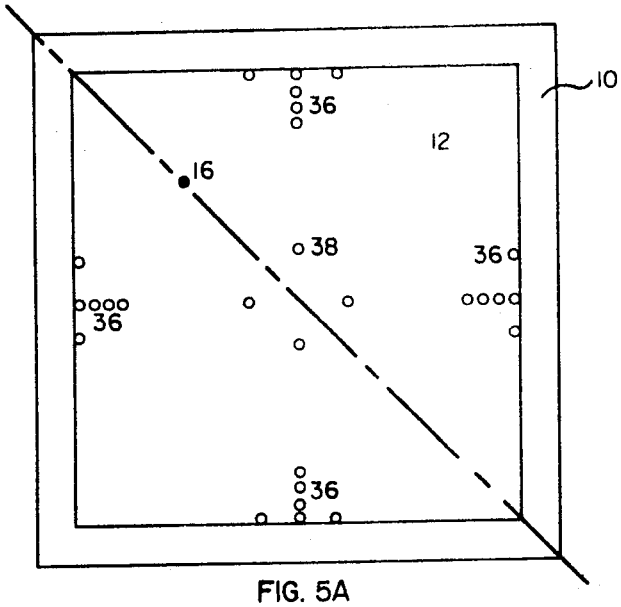
FIGS. 5A–5D illustrate a microstrip antenna of the present invention showing locations of shorting means to obtain both selectable mode capability and polarization diversity.
Figure 5B:
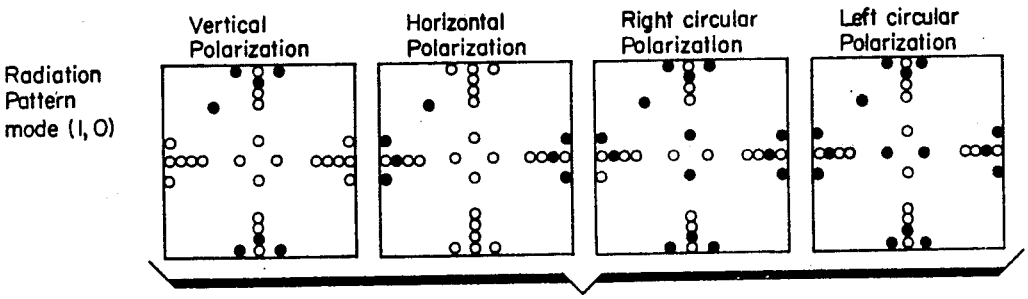
Figure 5C:
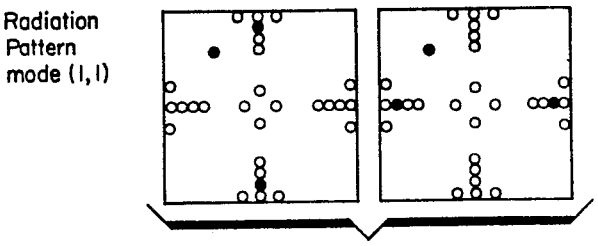
Figure 5D:
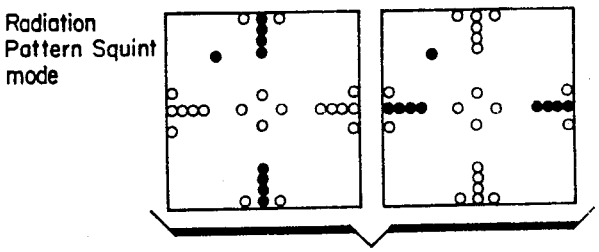

FIGS. 5A–5D illustrate an embodiment of the present invention with the addition of polarization diversity. As is known in the antenna art, to obtain circular polarization, the conductive patch 12 is made almost square and the rf transmission path 16 is placed on the diagonal. The distance that the transmission path 16 is from the center of the patch determines the input impedance. The shorting means shown in FIG. 5A generally at 36 determine the radiation pattern and the linear polarization of the antenna, whereas the shorting means shown generally at 38 determine the circular polarization of the antenna. For example, FIG. 5B illustrates how vertical, horizontal, right circular and left circular polarization can be obtained by shorting alternate selected shorting means. These polarizations are obtainable in three different radiation patterns as shown at the left of the FIGS. 5B–5D.

Figure 6A:
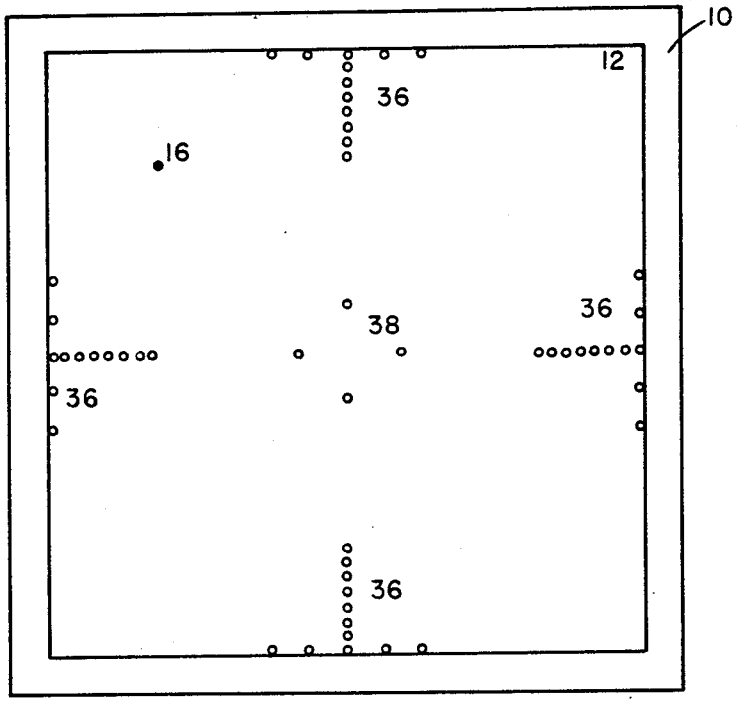
FIGS. 6A–6D illustrate a microstrip antenna of the present invention showing locations of shorting means to obtain selectable mode capability, polarization diversity and frequency-agility.
Figure 6B:
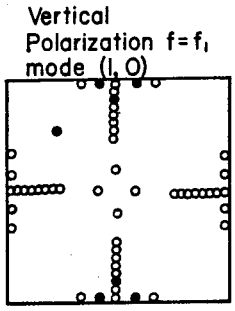
Figure 6C:
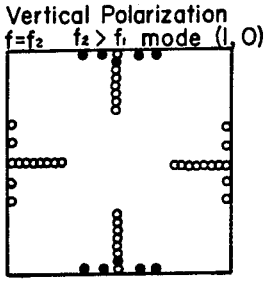
Figure 6D:
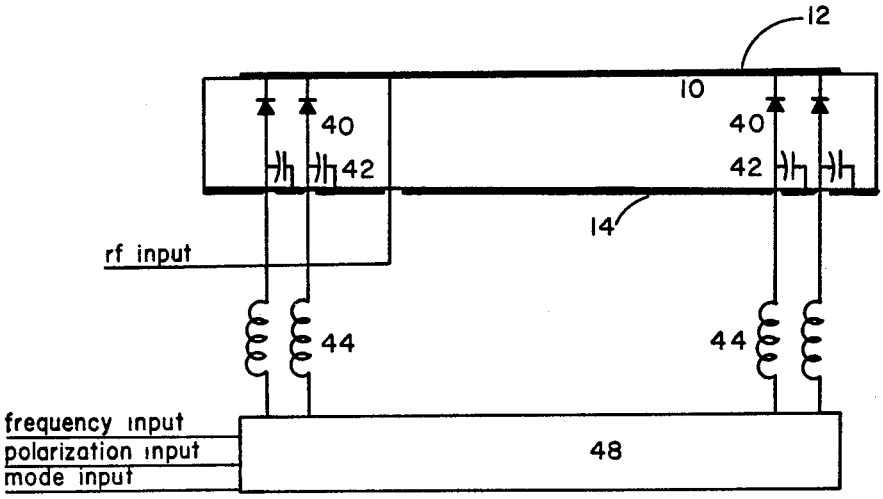

FIG. 6A illustrates an embodiment of the present invention with polarization diversity and frequency-agility. Frequency-agility is obtained, in this example, by adding additional shorting means locations to those shown in FIG. 5A. FIGS. 6B and 6C illustrate an example of the different frequencies obtainable by shorting alternate selected shorting means. For example, by shorting the shorting means shown in FIG. 6B, the frequency is less than the frequency of the same antenna as shown in FIG. 6C but with different shorting means shorted. It can be seen from this example that the same analysis as that given for FIGS. 5A–5D would hold for different polarizations and different modes. FIG. 6D is a schematic of the antenna as shown in FIG. 6A. In this figure, the shorting means are shown as switching diodes 40 coupled to the ground plane 14 by bypass capacitors 42 and coupled to control means 48 by rf chokes 44. The control means 48 provide a bias input to switch selected switching means 40 to provide the desired frequency characteristics, polarization and mode. Control means 48 is controllable easily and simply by digital computer means.

Figures 7A, 7B:
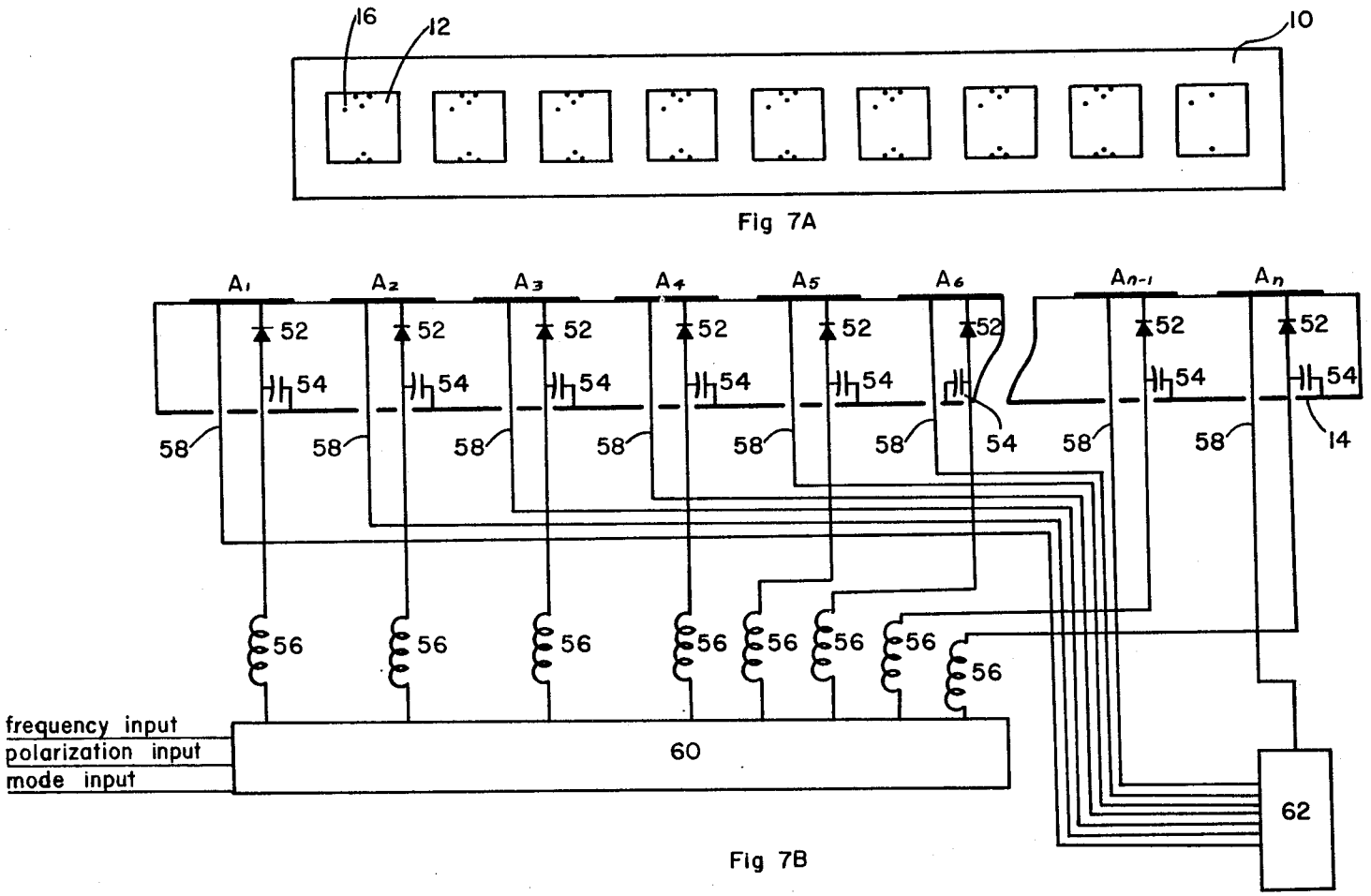
FIGS. 7A–7C illustrate a microstrip antenna array of the present invention and the radiation patterns resulting therefrom.
Figure 7C:
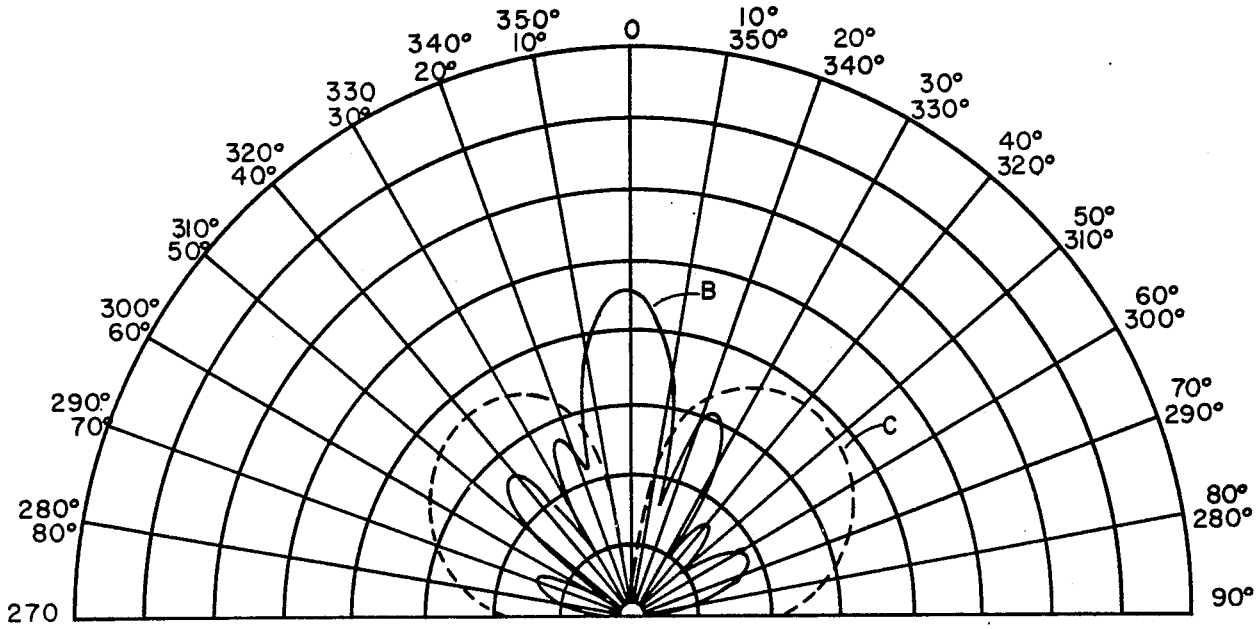

FIGS. 7A–7C illustrate the further embodiment of the present invention wherein multiple conductive patches are formed in an array pattern. The switchable mode microstrip antenna array, as shown in FIG. 7B, is made up of multiple conductive patches $A_1$-$A_n$, and a ground plane 14 formed on a dielectric substrate 10. Each conductive patch is provided with multiple shorting means, represented in FIG. 7B by a single switching diode 52. As described above, the switching diode is coupled to the ground plane by a bypass capacitor 54 and is further coupled to control means 60 by an rf choke 56. The control means 60, in response to a frequency input, a polarization input and a mode input, switches selected shorting means in each of the conductive patches $A_1$-$A_n$. Each of the conductive patches $A_1$-$A_n$ is connected to a means 62 by a transmission path 58. The means 62 can either be a transmitting means to provide rf energy via transmission paths 58 to each of the conductive patches $A_1$-$A_n$, or means 62 can be a comparing means to compare the radiation received from each individual conductive patch with radiation received by any other conductive patch. For example, in the illustration provided by FIGS. 7A–7C, a first portion of conductive patches $A_1$-$A_{n-1}$ can be switched by control means 60 to provide a first radiation pattern represented by the solid curve B in FIG. 7C, and a second portion of conductive patches, in this case a single patch, $A_n$, can be switched to provide a second radiation pattern represented by the dashed curve C in FIG. 7C. By being able to compare the signals received by each portion of conductive patches by means 62, the direction of an incoming signal can be determined by side-lobe cancelling. As is known in the prior art, the radiation pattern represented by the solid curve B in FIG. 7C contains substantial side-lobes which in some instances can cause confusion in the interpretation of the received signal. By comparing the signal received from the portion of conductive patches that result in the solid curve B radiation pattern with the signal received by the portion of conductive patches resulting in the radiation pattern C, it can be determined whether the signal is within or without the major lobe of the radiation pattern represented by solid curve B. This is done, for example, by determining whether the signal received from the first portion of conductive patches is larger than that received from the second portion of conductive patches, and vice-versa. This results in the effective cancelling of the side-lobes of the radiation pattern represented by solid curve B. It can be appreciated that other groupings of conductive patches can be used in alternative ways, and we do not wish to be limited to the specific example as shown herein.

Figure 8:
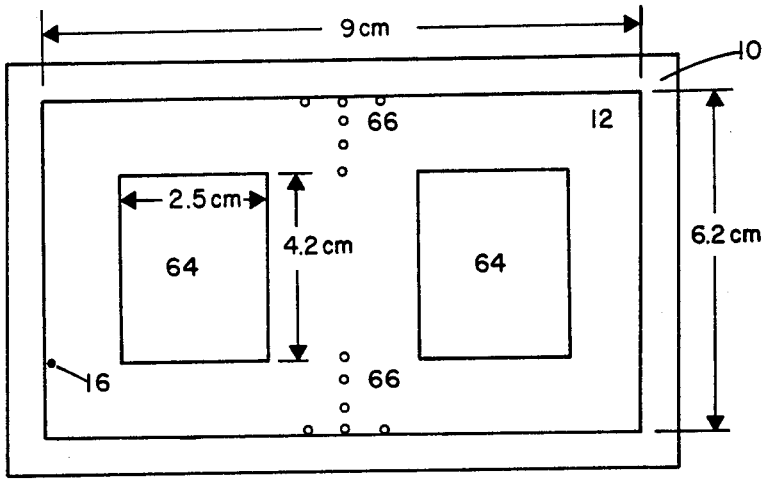
FIG. 8 illustrates a microstrip antenna of the present invention with sections removed to further change the frequency characteristics.

FIG. 8 illustrates another embodiment of the present invention wherein shorting locations are provided in a microstrip antenna conductive patch which has sections 64 of the conductive material removed. These sections further change the frequency characteristics of the microstrip antenna conductive patch as is known in the prior art.

While the invention has been described with reference to the accompanying drawings, it is to be clearly understood that the invention is not to be limited to the particular details shown therein as obvious modifications may be made by those skilled in the art. The embodiments of the invention should only be construed within the scope of the following claims.

What we claim is:

1. A selectable mode microstrip antenna comprising:
a dielectric substrate;
a conductive patch on one surface of said substrate, said conductive patch being substantially rectangular with a first pair of sides with dimensions "a" and a second pair of sides with dimensions "b", said conductive patch having a first centerline parallel to said first pair of sides and a second centerline parallel to said second pair of sides;
a conductive layer, forming a ground plane, on an opposed surface of said substrate;
means for providing a radio frequency transmission path to said conductive patch; and
means for selecting the radiation pattern of said conductive patch comprising first multiple pairs of switchable shorting means for providing electrically conductive paths between said conductive patch and said ground plane, said multiple pairs of switchable shorting means selectively positioned symmetrically on said first centerline around a center of said first centerline and substantially away from said center.

2. A selectable mode microstrip antenna as recited in claim 1, further comprising:

second multiple pairs of switchable shorting means selectively positioned symmetrically around said first centerline on said second pair of sides.

3. A selectable mode microstrip antenna as recited in claim 2, further comprising:

third multiple pairs of switchable shorting means selectively positioned symmetrically on said second centerline around a center of said second centerline and substantially away from said center.

4. A selectable mode microstrip antenna as recited in claim 3, further comprising:

fourth multiple pairs of switchable shorting means selectively positioned symmetrically around said second centerline on said first pair of sides.

5. A selectable mode microstrip antenna as recited in claim 4, further comprising:

first means for selectively switching each of said first, second, third and fourth pairs of multiple shorting means to select a mode of radiation.

6. A selectable mode microstrip antenna as recited in claim 5, further comprising:

means for selecting the polarization of said conductive patch.

7. A selectable mode microstrip antenna as recited in claim 6 wherein said means for selecting the polarization of said conductive patch comprises:

second means for selectively switching each of said first and second multiple pairs of shorting means to obtain a linear polarization in a first direction.

8. A selectable mode microstrip antenna as recited in claim 7 wherein said means for selecting the polarization of said conductive patch further comprises:

third means for selectively switching each of said third and fourth multiple pairs of shorting means to obtain a linear polarization in a second direction wherein said second direction is orthogonal to said first direction.

9. A selectable mode microstrip antenna as recited in claim 8:

wherein said first pair of sides and said second pair of sides are substantially equal in dimensions;

wherein said means for providing a radio frequency transmission path to said conductive patch is connected to said conductive patch at a position on a diagonal defined by said first and second pairs of sides;

further comprising fifth multiple pairs of switchable shorting means selectively positioned symmetrically around said centers of said first and second centerlines on said first and second centerlines and substantially close to said center; and fourth means for selectively switching each of said fifth multiple pairs of shorting means to obtain right on left circular polarization.

10. A selectable mode microstrip antenna as recited in claim 9 further comprising:

means for selecting the frequency characteristics of said conductive patch.

11. A selectable mode microstrip antenna as recited in claim 10 wherein said means for selecting the frequency characteristics of said conductive patch comprise:

sixth multiple pairs of switchable shorting means selectively positioned symmetrically around said centers, on said first and second centerlines and substantially away from said centers; and fifth means for selectively switching each of said sixth multiple pairs of shorting means.

12. A selectable mode microstrip antenna as recited in claim 11 wherein said switchable shorting means each comprise a switching diode.

13. A selectable mode microstrip antenna as recited in claim 12 wherein said first through fifth means for selectively switching said first through sixth multiple pairs of shorting means comprises control means for switching each pair of switchable shorting means.

* * * * *